US005490898A

United States Patent [19]

Koyama

[11] Patent Number: 5,490,898

[45] Date of Patent: Feb. 13, 1996

[54] COATING FILM TRANSFER TOOL

[75] Inventor: Kouhei Koyama, Osaka, Japan

[73] Assignee: Seed Rubber Company Limited, Osaka, Japan

[21] Appl. No.: 291,853

[22] Filed: Aug. 17, 1994

[30] Foreign Application Priority Data

Sep. 22, 1993 [JP] Japan ..... 5-259320

[51] Int. Cl.[6] ..... B44C 7/02

[52] U.S. Cl. ..... 156/540; 15/3.53; 15/104.94; 118/200; 118/257; 156/577; 156/579

[58] Field of Search ..... 118/106, 200, 118/257; 156/577, 579, 540; 400/695, 696, 700; 15/3.53, 104.94, 424, 425

[56] References Cited

U.S. PATENT DOCUMENTS

| | | | |
|---|---|---|---|
| 4,426,169 | 1/1984 | Hartmann | 400/696 |
| 4,521,471 | 6/1985 | Merrill | 400/696 |
| 4,547,088 | 10/1985 | Shattuck | 400/696 |
| 4,671,687 | 6/1987 | Tamai | 400/695 |
| 4,718,971 | 1/1988 | Summers | 156/579 |
| 4,826,562 | 5/1989 | Ehlis | 156/577 |
| 5,125,589 | 6/1992 | Manusch | 156/577 |
| 5,310,445 | 5/1994 | Tucker | 156/577 |
| 5,346,580 | 9/1994 | Elges et al. | 156/577 |
| 5,379,477 | 1/1995 | Tamai et al. | 118/257 |

FOREIGN PATENT DOCUMENTS

| | | | |
|---|---|---|---|
| 5-13800 | 2/1993 | Japan . | |
| 5-58097 | 3/1993 | Japan . | |
| 2157233 | 10/1985 | United Kingdom | 400/696 |

*Primary Examiner*—Laura Collins

*Attorney, Agent, or Firm*—Nikaido Marmelstein Murray & Oram

[57] ABSTRACT

A coating film transfer tool having a structure for allowing use as a kind of so-called writing tool and replacement of a coating film transfer tape. By placing a coating film transfer head in a coating film transfer tape replacement position, a coating film transfer tape can be guided in parallel with its winding attitude about pay-out reel and winding reel by a leading pressing part, and the coating film transfer tape can be easily detached from the head. On the other hand, by the head in an application position, the coating film transfer tape is guided by the leading pressing part, approximately directly facing to gripping surfaces of the case. Accordingly, the coating film transfer tape can be tightly pressed against a sheet surface or the like by holding the case itself like a writing tool.

18 Claims, 17 Drawing Sheets

COATING FILM TRANSFER TOOL

BACKGROUND OF THE INVENTION

1. Field of the Invention

The present invention relates to a coating film transfer tool for transferring a coating film such as a corrective paint layer and an adhesive layer on a coating film transfer tape onto a paper surface or the like, and more particularly to a cartridge-type coating film transfer tool allowing replacement of coating film transfer tapes, and having a structure to be usable with a writing tool-like feeling, as if handling a pencil or the like.

2. Description of the Related Art

As an example of this kind of coating film transfer tool, we proposed a coating film transfer tool disclosed in Japanese Laid-open Utility Patent No. 5-13800.

The coating film transfer tool is mainly used as an erasing tool for correcting errors or the like, and comprises, as shown in FIG. 17, a pay-out reel (c) with a coating film transfer tape (b) wound thereabout and a winding reel (d) for collecting the coating film transfer tape (b) as it is used contained rotatably provided in a case (a). This case (a) has a coating film transfer head (f) projecting from a front end thereof. The coating film transfer head (f) is for pressing the coating film transfer tape (b) against a transfer area (e.g., a correction area) (e), and is structured such that the coating film transfer tape (b) paid out of the pay-out reel (c) is dragged through a pressing part (g) in the front end of the head (f), and wound and held about the winding reel (d).

The case (a) is formed in a flat box-like shape, and has contour shape and size and width size sufficient for containing the pay-out reel (c) and winding reel (d). Flat front and back surfaces of the case (a), that is, front and back surfaces relative to the sheet surface of FIG. 17 provide gripping surfaces in operating the tool, and the pressing part (g) in the front end of the head (f) is arranged such that the coating film transfer tape (b) is guided approximately directly facing against the gripping surfaces.

Then, in order to erase an error by using the coating film transfer tool, the gripping surfaces (both front and back surfaces) of case (a) are held by fingers, and the case (a) is moved vertically to the sheet surface of FIG. 17, while the coating film transfer tape (b) is tightly pressed against the correction area (e) by means of the pressing part (g) in the front end of the head (f). In such manner, a corrective paint layer of the coating film transfer tape (b) in the pressing part (g) of the front end of the head (f) is applied onto the correction area (e), a letter or the like in the area is coated and erased, and the used coating film transfer tape (b) is collected by the winding reel (d).

In this case, the pressing part (g) in the leading end of the head (f) guides the coating film transfer tape (b) such that the tape generally faces against the gripping surfaces of case (a). This allows the coating film transfer tape (b) to be pressed tightly against the correction area (e) by means of the pressing part (g) in the leading end of the head (f), and the tool can be used with a writing tool-like feeling.

Incidentally, since an effective use of earth resources has been emphasized in these days, and it is desirable in a coating film transfer tool of the type to have such structure that only the coating film transfer tape (b), which is a consumable supply, can be replaced with a new one.

However, with a structure described above, because the pressing part (g) in the leading end of the head (f) guides the coating film transfer tape (b) with the tape approximately directly facing against the gripping surfaces of case (a), it was difficult to employ such structure that allows replacement of the coating film transfer tape (b) only.

In other words, in the coating film transfer tool, as the coating film transfer tape (b) is necessarily twisted through an angle of 90 deg. in the head part (f) due to the structure, the tool is difficult to be automatically assembled even in the manufacturer's side, and is actually manually assembled by skilled personnel.

On the other hand, to allow replacement of the coating film transfer tape (b) only, which is a consumable supply, the coating film transfer tool should be basically disassembled and assembled, and the coating film transfer tape (b) be replaced by a user. Thus, in order to allow replacement of the coating film transfer tape (b), development of such structure that a series of operations associated with replacement of the tape can be conducted easily, rapidly and securely even by a general user.

BRIEF SUMMARY OF THE INVENTION

Hence, it is a primary object of the invention to eliminate the conventional problems, and provide a novel coating film transfer tool.

It is another object of the invention to provide a coating film transfer tool used with a writing tool-like feeling, having a cartridge-type structure to allow replacement of coating film transfer tapes, and constructed suitably to meet the requirement of saving resources.

It is further object of the invention to provide a coating film transfer tool allowing a coating film transfer head to be moved accurately and stably to a desired location in so-called lateral pulling use, and capable of erasing letters or the like, and applying an adhesive stably and securely.

It is still other object of the invention to provide a coating film transfer tool used with a writing tool-like feeling as operating a pencil, ball-point pen, fountain pen or the like by horizontally moving a case like drawing a line with a writing tool, and easily operated.

A coating film transfer tool of the invention comprises a pay-out reel with a coating film transfer tape wound thereabout and a winding reel for collecting the coating film transfer tape as it is used contained rotatably and removably in a case. This case has a coating film transfer head projecting in a front end of the case for pressing the coating film transfer tape against a part to which the coating film is to be transferred. The coating film transfer tape paid out of the pay-out reel is dragged through a pressing part in the front end of the head, and wound about the winding reel. The head is rotatably operative between a coating film transfer tape replacement position and an application position, and the coating film transfer tape is guided by the pressing part in the front end of the head as it is wound about the pay-out and winding reels in the coating film transfer tape replacement position, and approximately directly facing against gripping surfaces of the case in the application position.

Then, when the coating film transfer tool of the invention is used as an erasing tool for correcting errors, the pressing part in the front end of the head is abutted to a starting end of a transfer area to be corrected, then, the case is moved transversely, that is, laterally against a sheet surface or the like, and stopped at a terminal end of the transfer area. In such manner, a corrective paint layer of the coating film transfer tape in the pressing part in the front end of the head is released from the film base, and transferred to the transfer area, thus, the error is coated and erased, while the film base with only a release agent remaining thereon is collected by the winding reel after use.

In such case, because the coating film transfer tape is guided approximately directly facing against the gripping surfaces of the case by the pressing part in the front end of the head, it can be tightly pressed against a sheet surface or the like by means of the pressing part in the front end of the head by holding the case itself in an attitude similar to that of a writing tool, and a superior controllability is obtained.

When an entire length of the coating film transfer tape is rewound from the pay-out reel to the winding reel for collection, the used tape is replaced with a new coating film transfer tape.

This is achieved, firstly, by rotating the head from the application position to the coating film transfer tape replacement position. By such operation, the coating film transfer tape in the head part is changed in attitude from approximately 90 deg. twisted to parallel in relation to the winding attitude of the pay-out and winding reels, and assumes an attitude for easy detachment from the head.

Succeedingly, after removing the used coating film transfer tape together with the pay-out and winding reels by opening the case, an unused new coating film transfer tape is placed in position together with new pay-out and winding reels as replacement to the used tape. In this operation, the coating film transfer tape can be attached to the head as it is wound about the pay-out and winding reels.

Then, the case is closed again, and the head is rotated from the coating film transfer tape replacement position to the application position. In such manner, the coating film transfer tape in the head part is changed in attitude from parallel to approximately 90 deg. twisted in relation to the winding attitude of the pay-out and winding reels so that it faces approximately directly against the gripping surfaces of the case, and assumes an attitude for use with a writing tool-like feeling.

Here, the coating film transfer tape "facing approximately directly against the gripping surfaces of the case" means that front and back surfaces of the coating film transfer tape approximately directly faces the gripping surfaces of the case, in other words, front and back surfaces of the coating film transfer tape is approximately in the same direction as that of the gripping surfaces of the case, and this definition is comprehensively applicable to the specification.

The above and other objects and features related to the invention will be better understood by reading the detailed description taken in conjunction with the accompanying drawings and novel facts disclosed in the claims.

DETAILED DESCRIPTION OF THE PREFERRED EMBODIMENT

Figure 1:
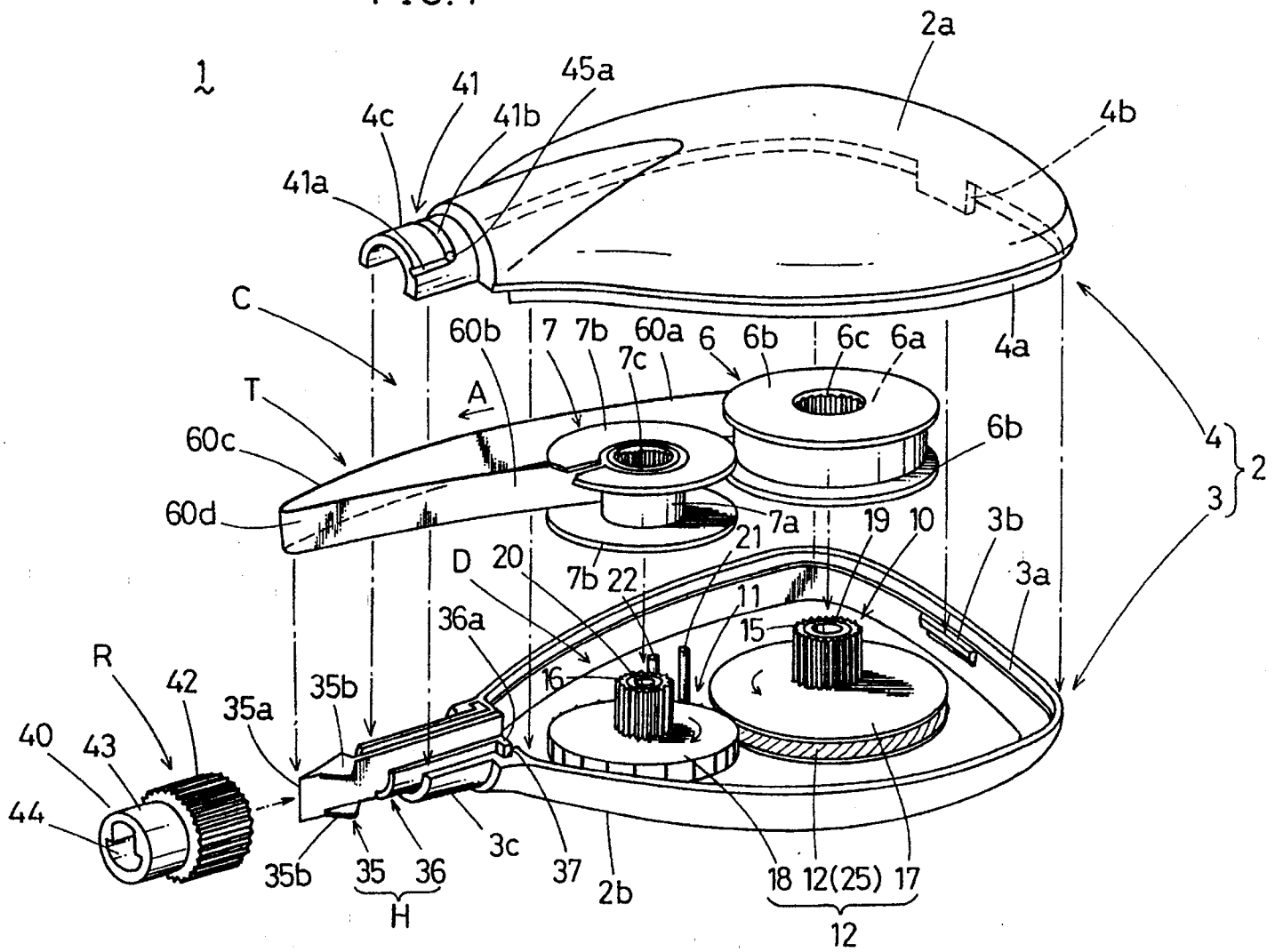
FIG. 1 is an exploded perspective view of an erasing tool forming a coating film transfer tool according to embodiment 1 of the invention.

Embodiments of the invention are described below by referring to the drawings.

FIGS. 1 through 16 show coating film transfer tools according to the invention, in which identical components or elements are shown by same reference numerals.

Embodiment 1

In FIGS. 1 to 5, a coating film transfer tool according to the invention is shown, which is particularly used as an erasing tool for correcting errors or the like. The coating film transfer tool 1 is of a cartridge type allowing replacement of a coating film transfer tape T as a consumable supply, and comprises, as shown in FIG. 1, a tape cartridge C, tape drive D, coating film transfer head H and rotative part R provided in a hand-held case 2. In the erasing tool 1, the head H is rotative between a coating film transfer tape replacement position (and longitudinal pulling use position) X shown in FIG. 2 and an application position (lateral pulling use position) Y shown in FIG. 4. Structural parts are now described, respectively.

I. Case 2

A case 2 is formed in a flat box-like shape, and has front side geometric and widthwise dimensions sufficient for containing the tape cartridge C and tape drive D. As described later, flat front and back surfaces 2*a* and 2*b* of the case 2 provide gripping surfaces in operation.

The case 2 is a plastic molding formed by injection molding or the like, and has a divided structure comprising a main body 3 and a capping body 4 for allowing disassembly. For this purpose, a mating recess 3*a* is formed in an opening of the main body 3 almost entirely along an inner circumference thereof, and a mating rib 4*a* of the capping body 4 is fitted into the mating recess 3*a*. In addition, an engaging portion 3*b* is provided in a rear end of the main body 3, and a stopper claw 4*b* of the capping body 4 engages with the engaging portion 3*b*. The main body 3 and capping body 4 have semicylindrical portions 3*c* and 4*c* in a front end thereof, respectively, and the semicylindrical portions 3*c* and 4*c* are integrated by a cap member 40, which will be described later.

Thus, in assembling the case 2, firstly, the stopper claw 4*b* of capping body 4 is engaged with the engaging portion 3*b* of main body 3, and the semicylindrical portions 3*c* and 4*c* are, then, combined with each other, while the mating rib 4*a* is fitted into the mating recess 3*a*. Finally, by fitting the cap member 40 over the integrated part (cylindrical front end) 5, the case 2 is completely assembled.

II. Tape cartridge C

A tape cartridge C comprises a set of a pay-out reel 6 with the coating film transfer tape T wound thereabout and a winding reel 7 for collecting the used coating film transfer tape T'. The tape cartridge C is detachably attached in a tape drive D of the main body 3. Before attachment, the tape cartridge C is held by a fixing member (not shown) for fixing the reels 6 and 7, although such status is not shown in a drawing.

The coating film transfer tape T structurally consists of a film base (about 25 to 38 μm thick) of such plastic material as polyester and acetate films or paper, such release agent layer as vinyl chloride-vinyl acetate copolymer resin and lower molecular polyethylene formed on one side of the base film, a white corrective paint layer over the release agent layer, and such adhesive (pressure sensitive adhesive) layer as pressure adhesive polyurethane applied still over the paint layer (detailed structure not shown). As the corrective paint layer, a so-called dry type paint is employed that allows writing in a corrected area immediately after the paint is transferred.

The pay-out reel 6 and winding reel 7 respectively comprise drum parts 6*a*, 7*a* with the coating film transfer tape T, tape guide flanges 6*b*, 7*b* provided in either sides of the drum parts 6*a*, 7*a*, and mounting holes 6*c*, 7*c* having such toothed engagement part as spline provided in the diametric center.

III. Tape drive D

A tape drive D is provided in the main body 3. The tape drive D comprises mainly a rotating pay-out part 10 for rotatably driving the pay-out reel 6, a rotating winding part 11 for rotatably driving the winding reel 7 and a interlocking part 12 for interlocking the rotating parts 10, 11.

The rotating pay-out part 10 and rotating winding part 11 comprises hollow rotating shaft parts 15, 16 formed integrally with flat rotating disks 17, 18, respectively. The rotating shaft parts 15, 16 are rotatably supported by on the outer circumference of hollow supporting shafts 19, 20 provided upright in an inner side of the main body 3. The hollow supporting shafts 19, 20 have a stopper part 100 in an upper end thereof, as shown in FIG. 7.

Figure 7:
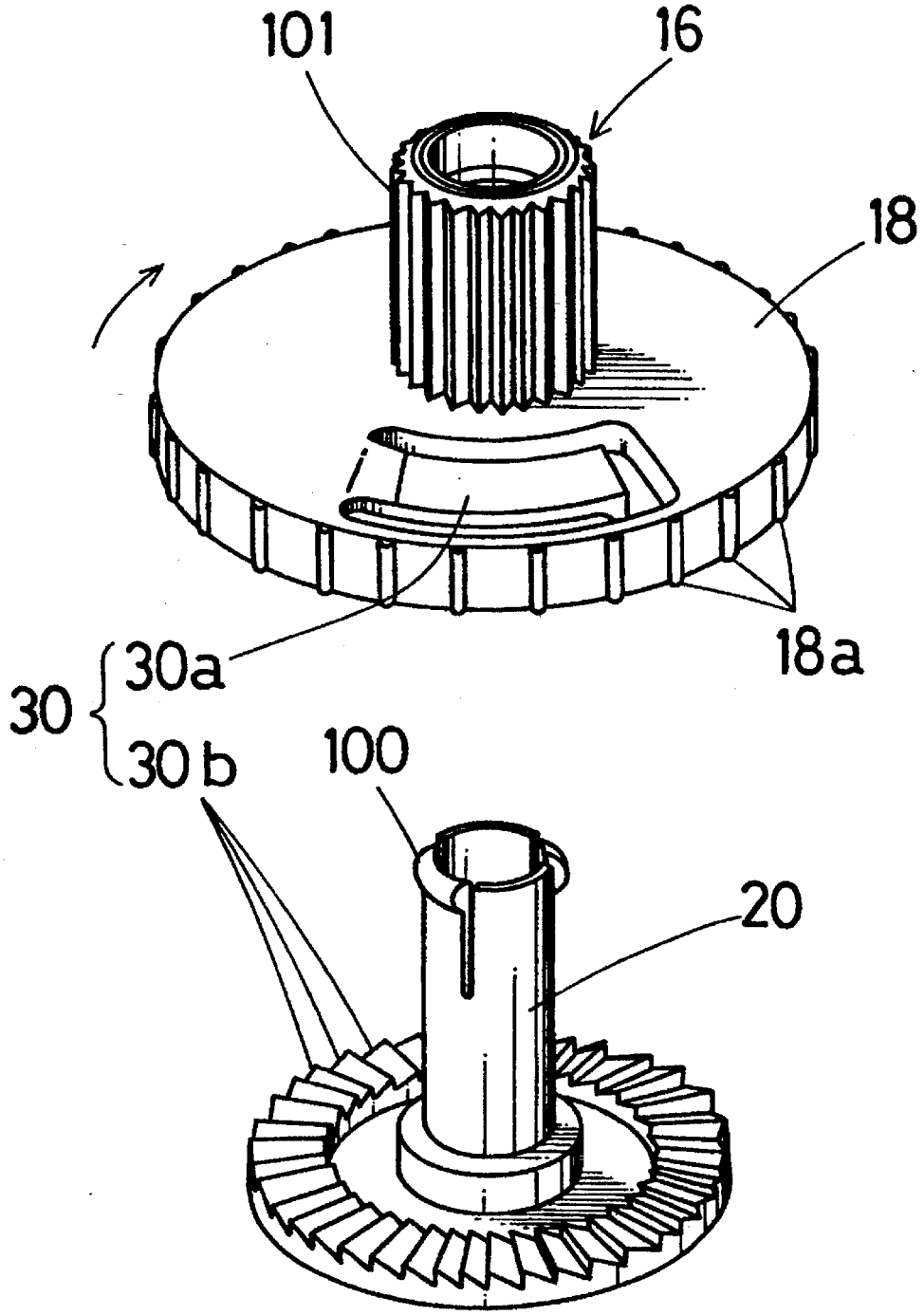
FIG. 7 is an exploded perspective view of a backstop mechanism in the tape drive.

On an outer circumference of the rotating shaft parts 15, 16, a toothed engagement part 101 such as spline is formed, respectively, as shown in FIG. 7. The toothed engagement part 101 has a geometric dimensions corresponding to the toothed engagement part in mounting holes 6*c*, 7*c* of the pay-out and winding reels 6, 7. The mounting holes 6*c*, 7*c* of the reels 6, 7 are disengageably fitted with and supported by the toothed engagement parts 101, 101, and the pay-out and winding reels 6, 7 are attached to the rotating shaft parts 15, 16 for integral rotation with the shafts.

In this case, the rotating disks 17, 18 serve as receptacle support surfaces for the pay-out and winding reels 6 and 7. In association with them, a pair of guide pins 21, 22 for guiding the coating film transfer tape T are provided upright in the vicinity of attaching position of the pay-out and winding reels 6, 7 in the inner surface of main body 3.

Figure 6:
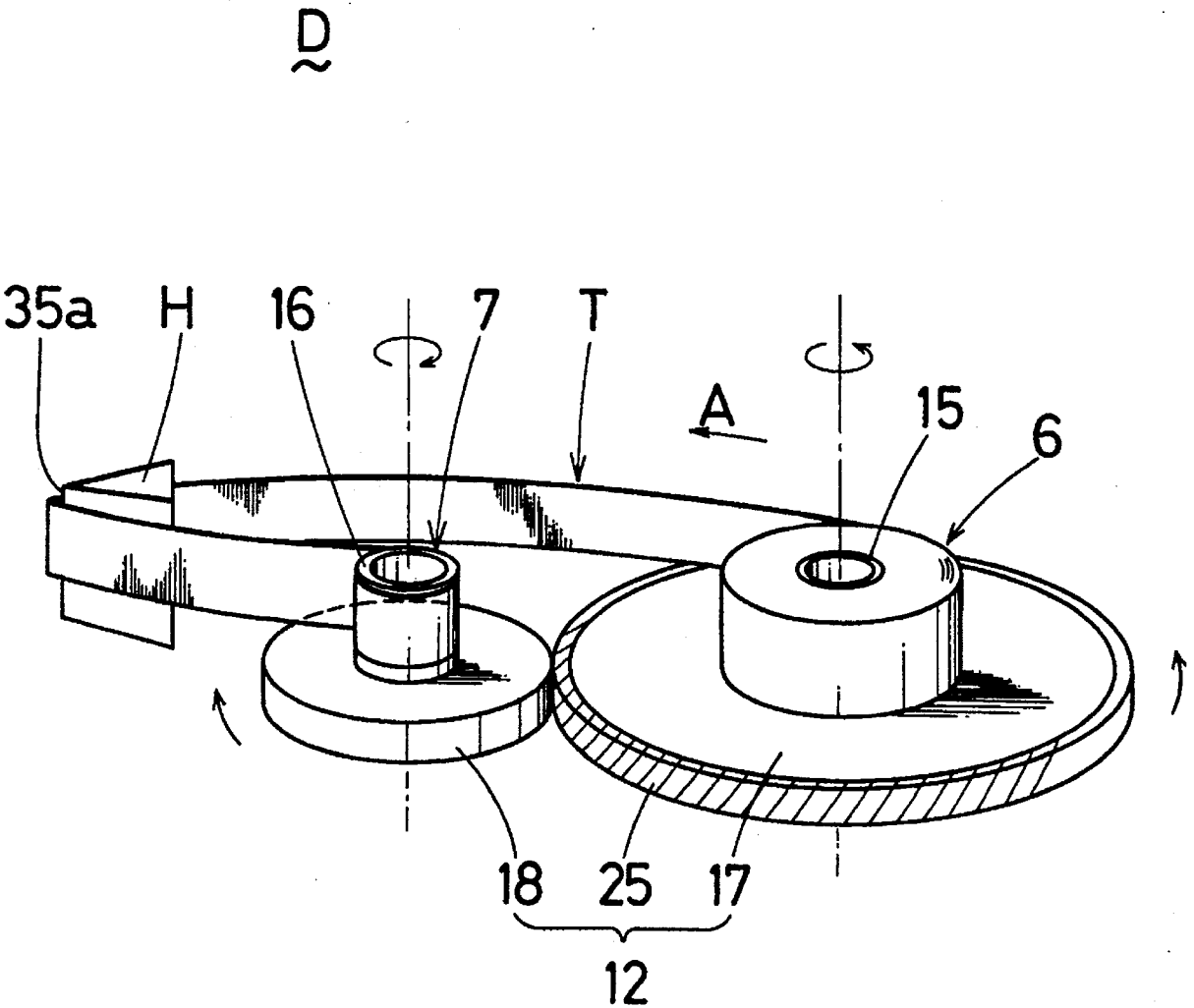
FIG. 6 is a perspective view schematically showing a basic structure of a tape drive in the erasing tool.

The interlocking part 12 is for interlocking the rotating winding part 11 to the rotating pay-out part 10, and comprises the rotating disks 17, 18 and slide means 25, as shown in FIG. 6.

The slide means 25 serves for transferring rotational movement between the rotating parts 10, 11, and functioning additionally as a slide means to synchronize pay-out and winding speeds of the coating film transfer tape T in the pay-out and winding reels 6, 7, and actually comprises a frictional member, for example, an O ring of elastomer such as silicone rubber.

The frictional member 25 is attached to an outer circumference of one rotating disk 17, and constructed in such manner that it can frictionally engage with the other rotating disk 18 in an outer circumference thereof. For this purpose, anti-slipping ribs 18*a*, 18*a*, . . . as shown in FIG. 7 are formed on the outer circumference of rotating disk 18 to increase frictional resistance to the frictional member 25. The anti-slipping rib 18*a* and the frictional member 25 may be arranged in a structural relationship contrary to that of the figure, that is, the frictional member 25 may be attached to the outer circumference of rotating disk 18 that is in the driven side, and the anti-slip rib formed on the outer circumference of rotating disk 18 that is in the driving side (not shown).

The ratio of rotation or ratio of outer diameter between the rotating disks 17, 18 in the driving and driven sides is appropriately set, considering a winding diameter of the coating film transfer tape T in the reels 6, 7, so that the coating film transfer tape T can be smoothly paid out, and wound. In the embodiment shown, the rotating disk 18 in the driven side is set, in diameter, at approximately half of the rotating disk 17 in the driving side.

Accordingly, by pressing action of the coating film transfer head H, as will be described later, when a tensile force (in the direction of arrow A) applied to the coating film transfer tape T acts as a rotational torque to the pay-out reel 6, the pay-out reel 6 and, therefore, the rotating disk 17 of rotating pay-out part 10 that is integrated with the pay-out reel 6 in the rotating direction are rotated. The torque effects rotation of the rotating disk 18 of rotating winding part 11 in the driven side by means of the frictional force of frictional member 25 and, accordingly, associated rotation of the winding reel 7 that is integrated with the rotating disk 18 in the rotating direction, and the used coating film transfer tape T' is automatically wound about the winding reel 7.

In this case, the ratio of rotation (corresponding to the ratio of outer diameter) between the rotating disks 17 and 18 in the driving and driven sides is constant at any time, while the ratio of outer diameter between the coating film transfer tape T about the pay-out reel and the coating film transfer tape T' about the winding reel 7 shows a time-course change, and is inconstant. In other words, as the tape is used, the outer diameter of the coating film transfer tape T about the pay-out reel 6 is gradually reduced, while that of the coating film transfer tape T' about the winding reel 7 is increased on the contrary.

Therefore, the winding speed of winding reel 7 is increased in comparison with the pay-out speed of pay-out reel 6 as time elapses, and the rotational torque acting to the pay-out reel 6 is gradually increased, because the speeds come to be unsynchronized with each other. Then, as the rotational torque overcomes the frictional force of frictional member 25, and the rotating disk 18 in the driving side slips in rotation relative to the rotating disk 17 in the driven side, the pay-out speed and winding speed are synchronized, and a smooth driving of the coating film transfer tape T is assured.

Incidentally, if the speeds remains in such unsynchronized condition, because the coating film transfer tape T is subjected to an excessive tensile force, such inconveniences may be caused that the tape T is elongated, or broken in the middle in a worst case.

Figure 8:
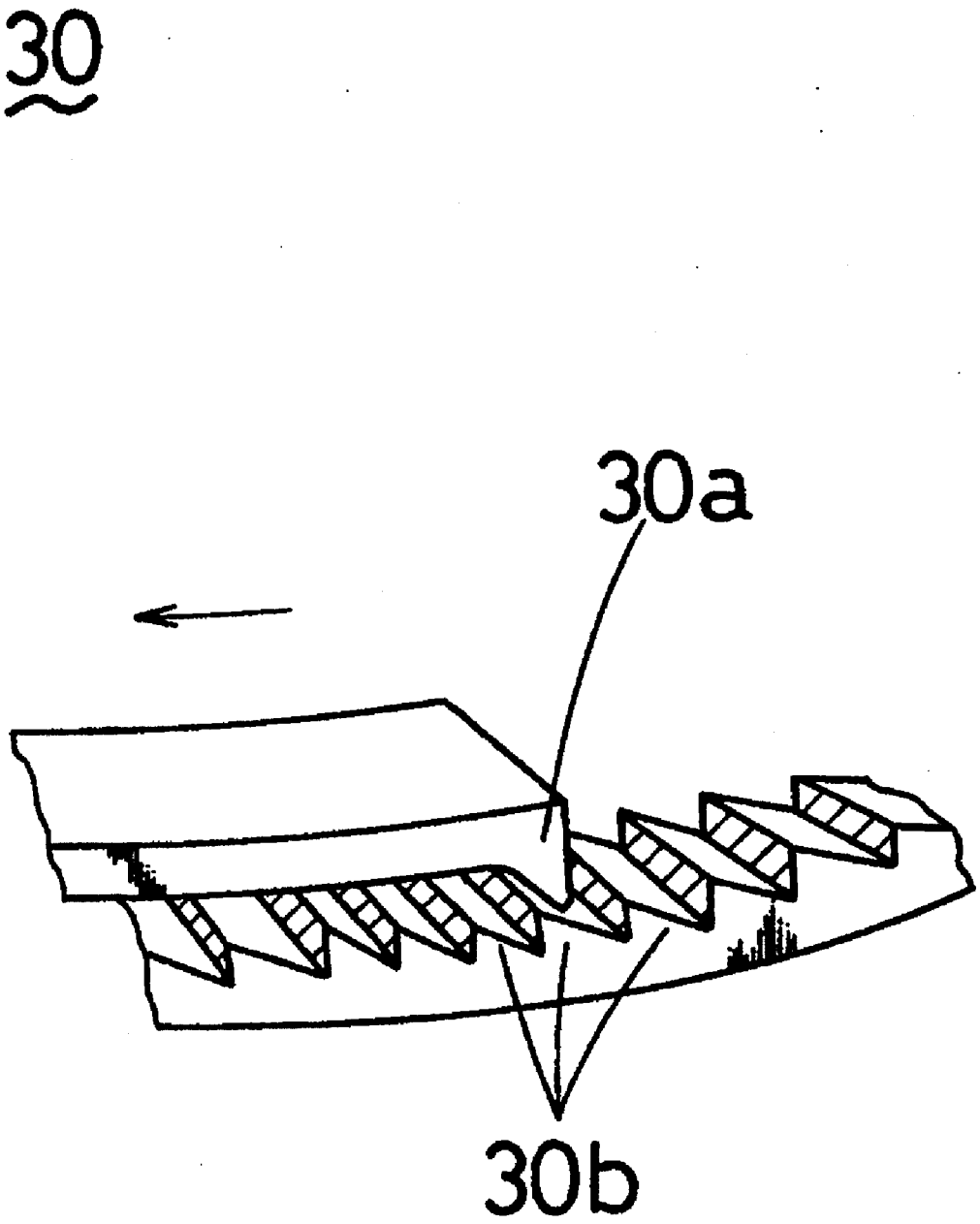
FIG. 8 is a magnified perspective view for explaining operation of the backstop mechanism.

Additionally, as shown in FIGS. 7 and 8, the rotating winding part 11 is provided with a backstop mechanism 30 for preventing inverse rotation of the reels 6, 7. The backstop mechanism 30 comprises a stopper claw 30*a* placed in the rotating disk 18 and multiple backstop claws 30*b*, 30*b*, . . . provided in the form of a ring concentric with the hollow supporting shaft 20 in an inner surface of the main body 3. The stopper claw 30*a* is oriented downward in a form of a thin plate elastically changing in shape in the vertical direction to the rotating disk 18. The backstop claws 30*b* have a wedge-like shape in section, as shown in the figure, that is inclined upward in the direction of normal rotation (shown by an arrow) of the winding reel 7, and falls approximately vertically from its peak.

Therefore, when the reels 6, 7 are turned in the direction of arrow, the stopper claw 30*a* is elastically changed in shape, and gets over the backstop claws 30*b*, 30*b*, to allow the normal rotation. On the contrary, when the reels 6, 7 are turned in the direction opposite to that of the arrow, the stopper claw 30*a* is engaged with one of the backstop claws 30*b*, 30*b*, . . . , and prevents the inverse rotation. The backstop mechanism 30 may be employed in the rotating pay-out part 10.

IV. Coating film transfer head H

A coating film transfer head H is for pressing the coating film transfer tape T against such correction area as an error in a sheet surface, and is attached to an inner circumference of the cylindrical leading or front end 5 of the case 2 for rotation about the axis.

The head H is made of a plastic material having some degree of elasticity, and comprises a main head 35 for guiding and pressing the coating film transfer tape T and a bearing part 36 held in the cylindrical front end 5.

The main head 35 is a thin plate slightly wider than the coating film transfer tape T, and is tapered in section such that it is gradually reduced in thickness toward its front end, and a front end 35*a* of the main head 35 provides a pressing part in the tool's front end for applying pressure to the coating film transfer tape T. In addition, the main head 35 is provided with guide flanges 35*b*, 35*b* in either edges thereof for guiding the coating film transfer tape T.

Figure 3:
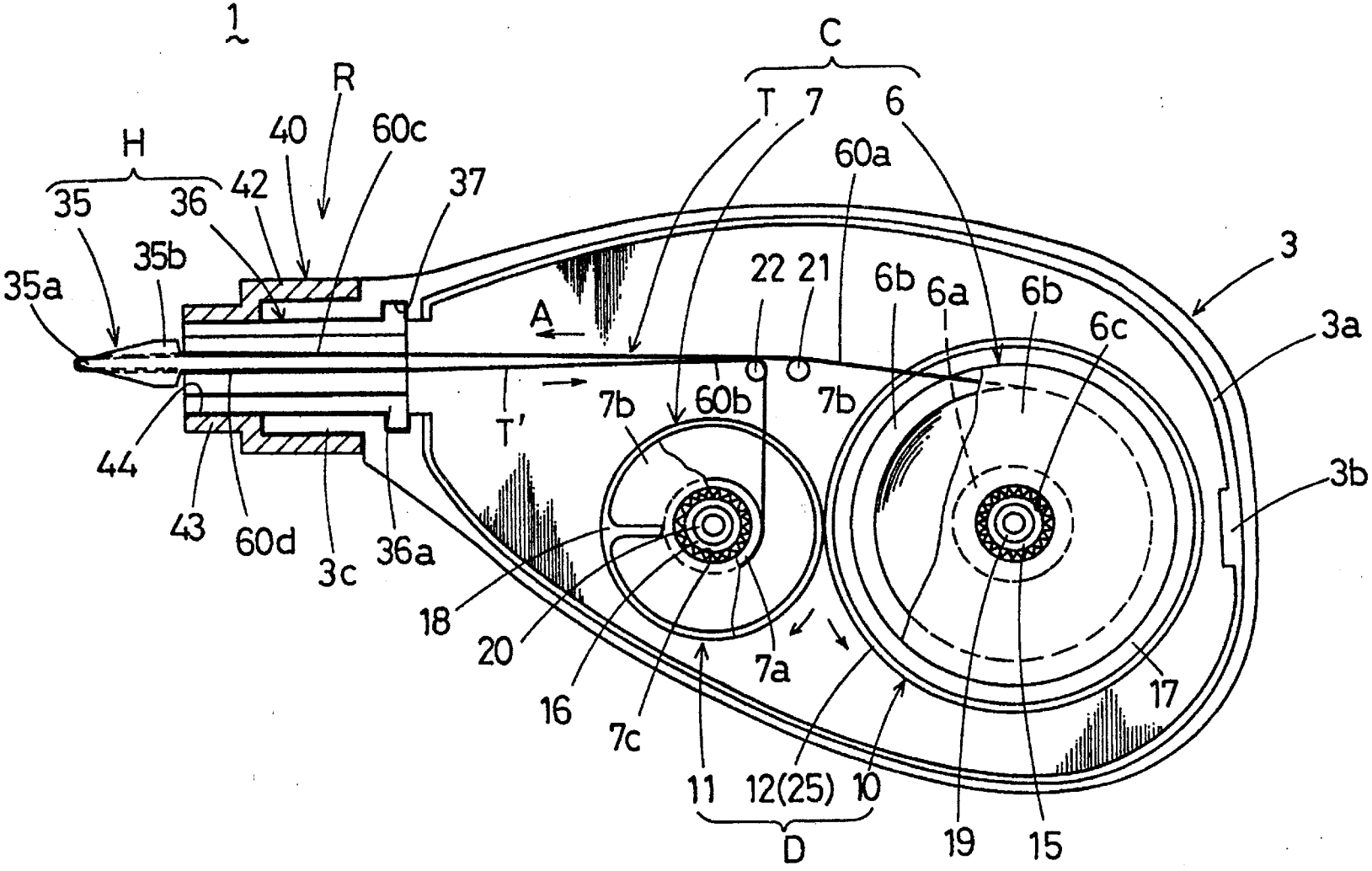
FIG. 3 is a partially sectional front view showing inside of the erasing tool with the coating film transfer head in the coating film transfer tape replacement position.
Figure 5:
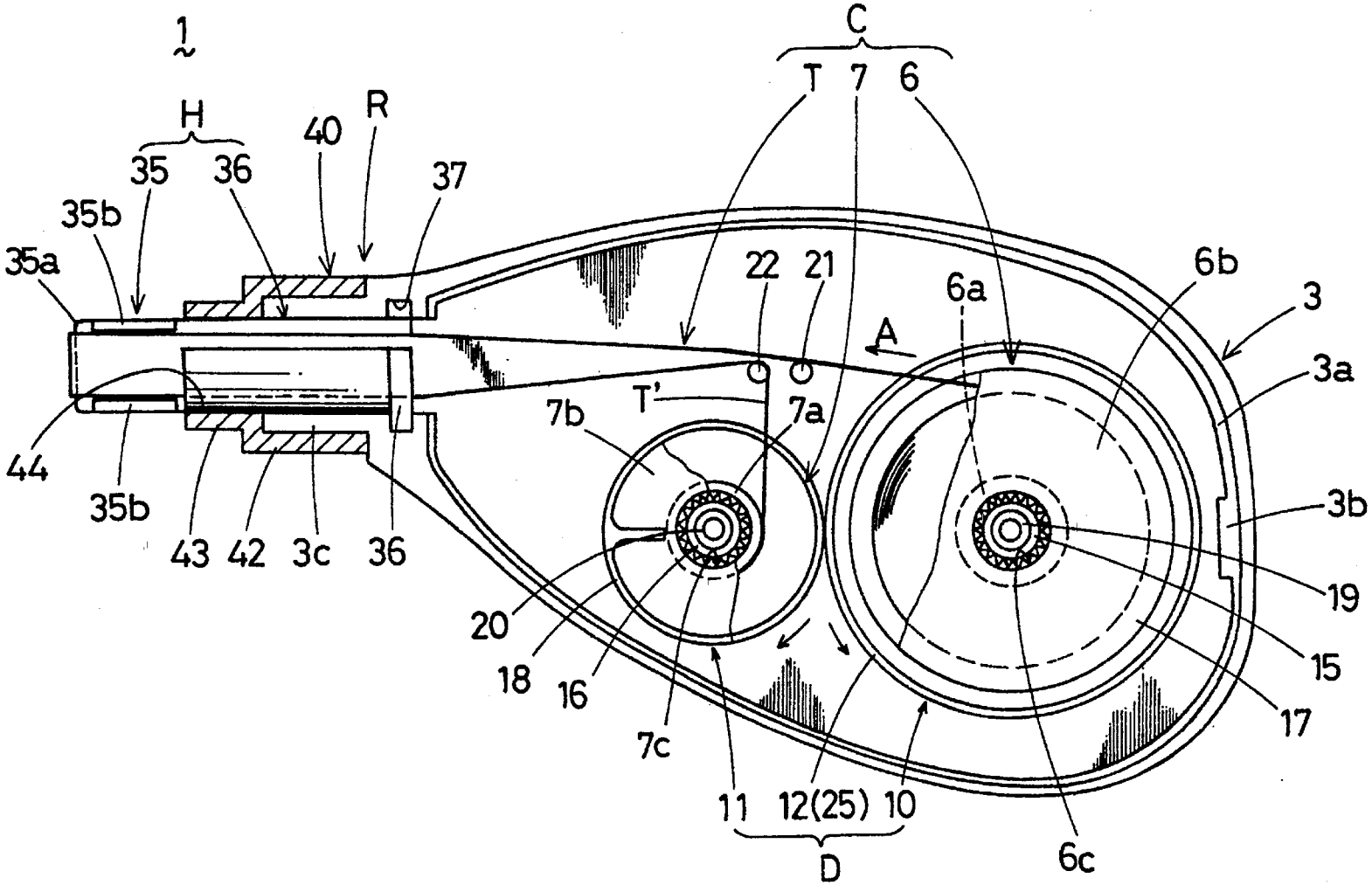
FIG. 5 is a partially sectional front view showing inside of the erasing tool with the coating film transfer head in the tape application position.

The bearing part 36 has an arcuate section open in an upper part thereof to form a semicylindrical shape, as shown in FIGS. 1, 3 and 5, and an outer diameter set in correspondence with the inner diameter of semicylindrical parts 3*c*, 4*c* of the case 2. Further, an arcuate flange 36*a* is formed in a base end of the bearing 36 for axial positioning of the bearing, and an arcuate engagement groove 37 is formed correspondingly in an inner base circumference of the semicylindrical parts 3*c*, 4*c*, respectively.

In such manner, the bearing 36 is axially supported rotatably in the inner circumference of semicylindrical parts 3*c*, 4*c*, and the arcuate flange 36*a* rotatably engaged with the arcuate engagement grooves 37, 37, thus, the head H is positioned axially in the cylindrical front end 5 of case 2, and attached rotatably about the axis thereof.

V. Rotative part R

A rotative part R is provided in the cylindrical front end 5 of case 2 for rotating the head H, and comprises a cap member 40 detachably attached to the cylindrical front end 5 and a positioning part 41 placed on the outer circumference of cylindrical front end 5.

The cap member 40 is an integral molding of plastic material, and comprises a base part 42 fitted over the cylindrical front end 5 and an engagement part 43 integrally engaged with the head H in the rotating direction.

The base part 42 serves as an assembly fixing member for the case 2 and a rotative part as well, has an inner cylindrical diameter set in such manner that the base part 42 is rotatably fitted over the outer circumference of cylindrical front member 5, and comprises multiple toothed anti-slip ribs formed on an outer circumference thereof.

The engagement part 43 is provided with a through hole 44 for receiving the head H. The through hole 44 is dimensionally configured such that the cap member 40 and head H are integrally engaged with each other in the rotating direction, when the head H is received through the hole 44. In other words, the through hole 44 comprises an upper part 44*a* and a lower part 44*b*. In a front view shown in FIG. 9, the upper part 44*a* is dimensionally configured so as to conform to the outer circumference of main head 35 of the head H, and the lower part 44*b* to the outer circumference of bearing 36 of the head H.

The positioning part 41 is provided on an outer circumference of the cylindrical front end 5, more particularly, on an outer circumference of the semicylindrical part 4*c* of the capping body 4 for resiliently positioning and fixing the cap member 40 in position in the rotating direction.

Figure 9:
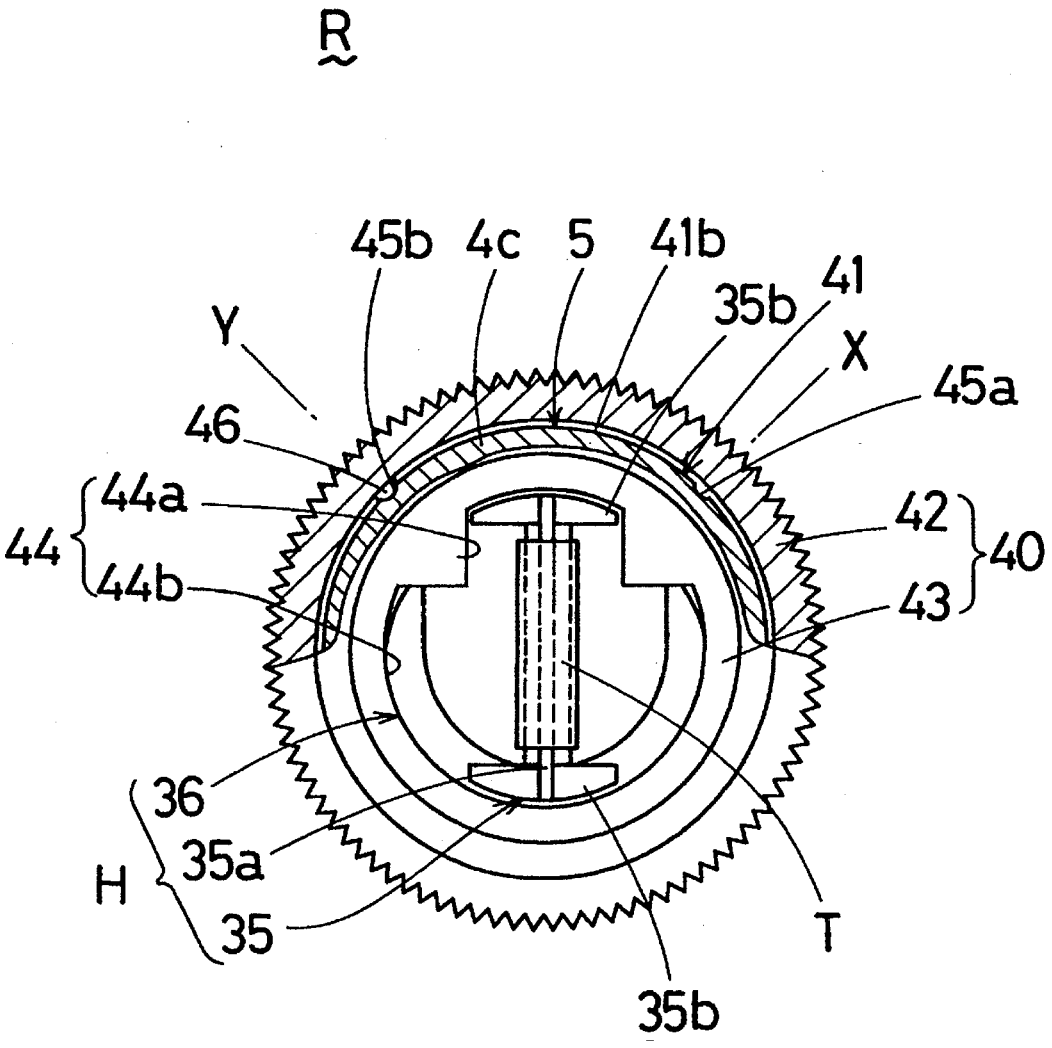
FIG. 9 is a perspective view of the erasing tool with the coating film transfer head and rotative part partly cut open showing the coating film transfer head in the tape application position.
Figure 10A:
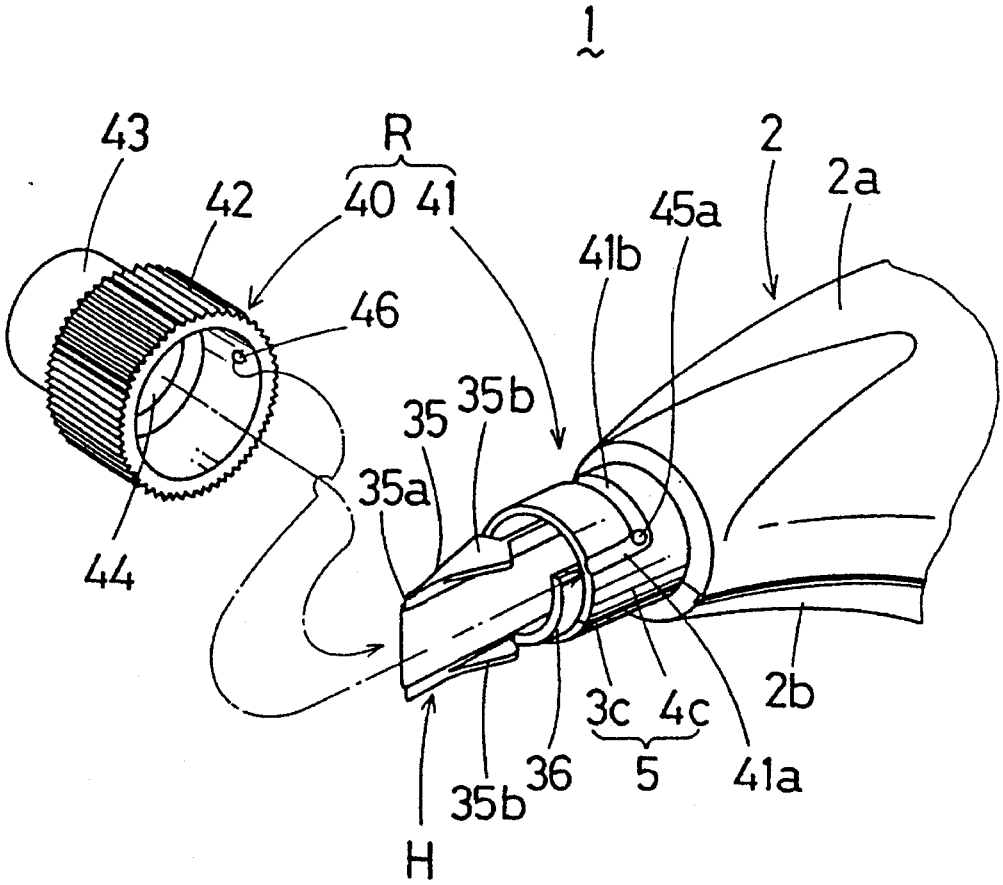
FIGS. 10 (a) and (b) is perspective views showing structure of the rotative part, FIG. 10 (a) showing a relation between the coating film transfer head and the rotative part, and FIG. 10 (b) a positioning portion in the rotative part.
Figure 10B:
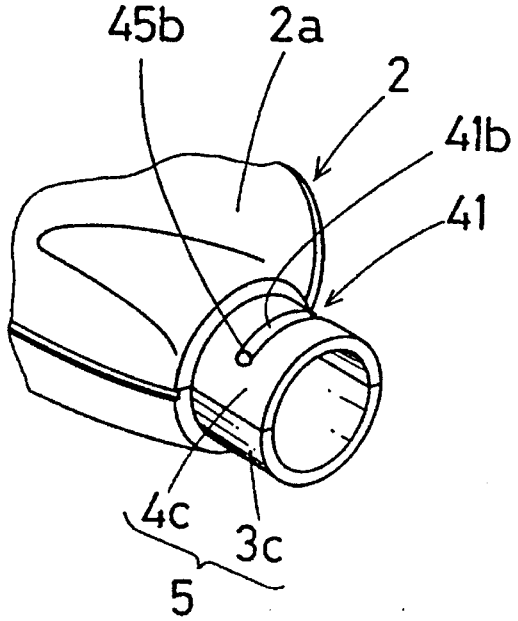

The positioning part 41 comprises, as shown in FIGS. 1, 9 and 10, a fit-in guide groove 41a extending straight in the axial direction of the cylindrical front end 5 and an anchor guide groove 41*b* extending from an end of the fit-in guide groove 41*a* in the circumferential direction of the cylindrical front end 5. In the embodiment shown, the anchor guide groove 41*b* is formed in a range of 90 deg. of central angle of the cylindrical front end 5, as shown in FIG. 9, and provided with first and second engagement parts 45*a* and 45*b* in either ends thereof.

The first and second engagement parts 45*a*, 45*b* are formed as recesses deeper than the guide grooves 41*a*, 41*b* . Either engagement recesses 45*a*, 45*b* are disengageably engaged with an engagement projection (engagement part) 46 that is provided in an inner circumference of the cap member 40. That is, the engagement projection 46 is geometrically dimensioned such that the engagement projection 46 can be guided along the guide grooves 41*a*, 41*b* , while it is elastically changed in shape to some relative extent, and fitted in the engagement recesses 45*a*, 45*b* by elastic restoration.

Figure 2:
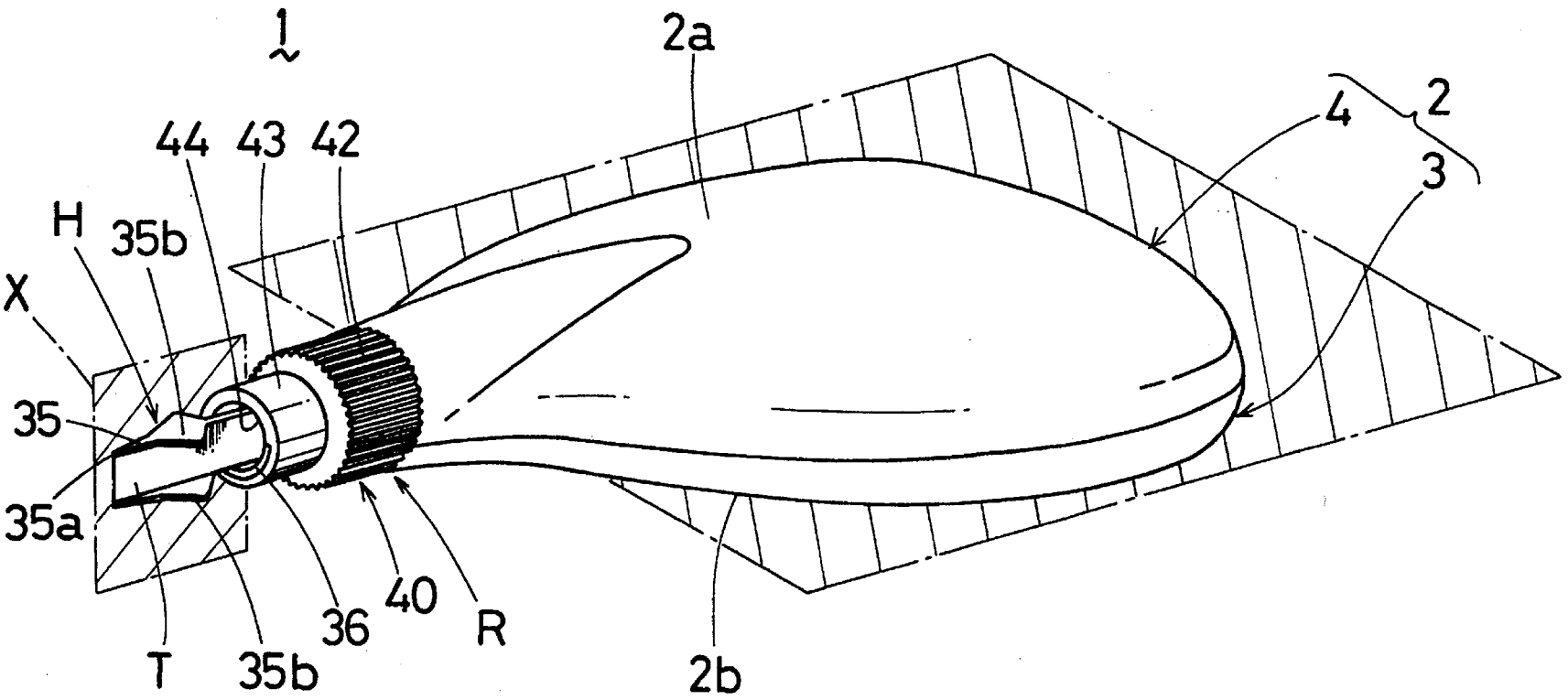
FIG. 2 is a perspective view of the erasing tool with a coating film transfer head in the coating film transfer tape replacement position.

Thus, when the engagement projection 46 of cap member 40 is in engagement with the first engagement recess 45*a*, the head H is, as shown in FIGS. 2 and 3, in the coating film transfer tape replacement position (and vertical pulling use position) X. In such condition, the pressing part 35*a* in the front end of head H guides the coating film transfer tape T in a same attitude as it is wound about the pull-out reel 6 and winding reel 7, that is, with the front and back surfaces of coating film transfer tape T oriented approximately perpendicularly (at right angle) to the gripping surfaces 2*a*, 2*b*.

Then, as shown in FIG. 3, the coating film transfer tape T paid out of the pay-out reel 6 is dragged past the pressing part 35*a* of head H by means of the guide pin 21, and wound about the winding reel 7 this time by means of the guide pin 22, while it is kept in that attitude.

Figure 4:
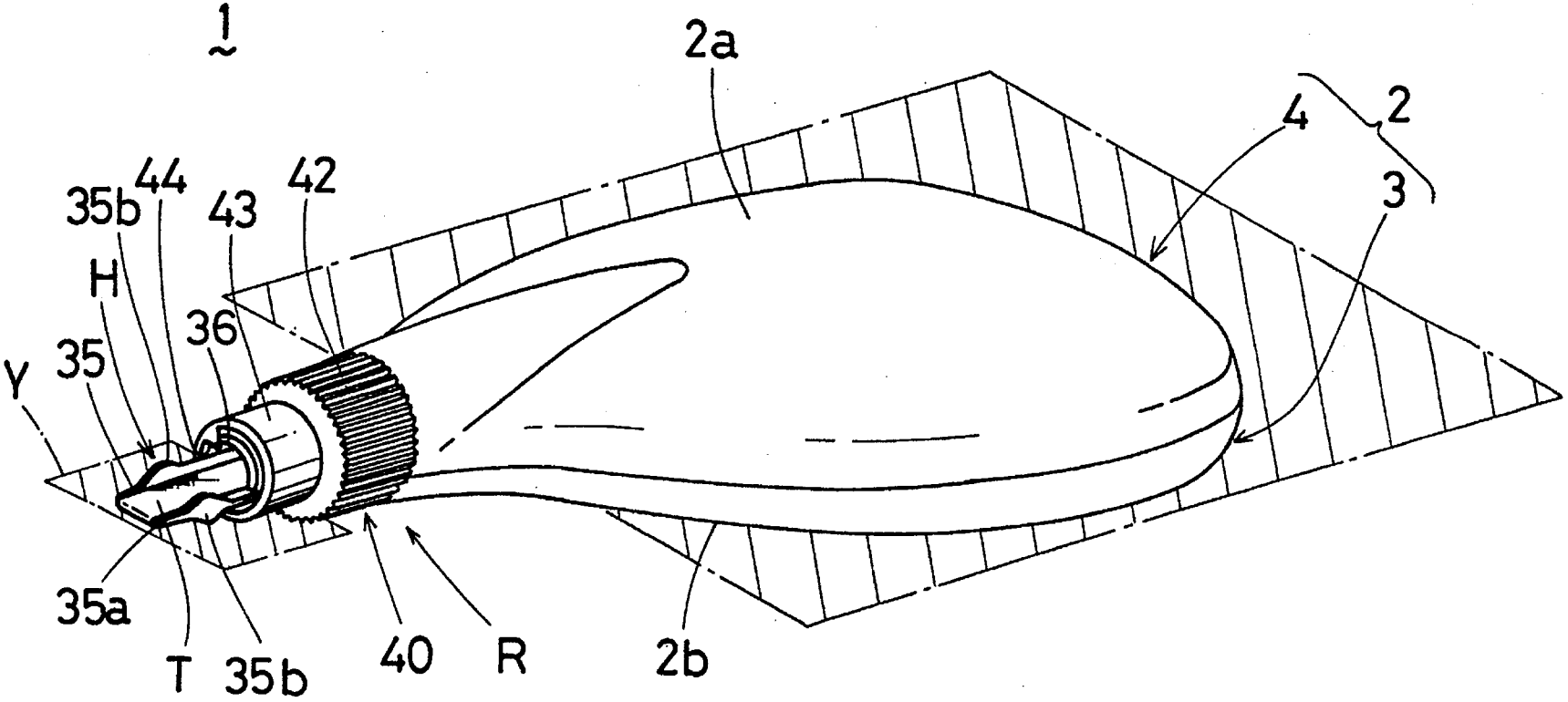
FIG. 4 is a perspective view of the erasing tool with the coating film transfer head in the application position.

On the other hand, when the engagement projection 46 is in engagement with the first engagement recess 45*a* (see FIG. 9), the head H is, as shown in FIGS. 4 and 5, in the application position (lateral pulling use position) Y. In such condition, the pressing part 35*a* of head H guides the coating film transfer tape T by positioning it approximately directly faced to the gripping surfaces 2*a*, 2*b* of case 2, that is, with the front and back surfaces of coating film transfer tape T facing to the direction approximately same as that of (parallel to) the gripping surfaces 2*a*, 2*b*.

In such case, the coating film transfer tape T paid out of the pay-out reel 6 is, as shown in FIG. 5, twisted through an angle of 90 deg. by the guide pin 21, then, dragged past the pressing part 35*a* in the front end of head H, untwisted to the original state now by the guide pin 22, and wound about the winding reel 7.

The specific structure of the rotative part R is not limited to the illustrated example alone. For example, the positioning part 41 may be disposed in the semicylindrical part 3*c* of the case main body 3, and in such a case, moreover, a new engagement projection 46 is additionally provided in the cap member 40, corresponding to the positioning part 41.

Likewise, the specific structure of the positioning part 41 may be also varied in design as far as similar functions are provided.

Operation of the erasing tool 1 constructed in such manner is described below.

A. Operation

Figure 11A:
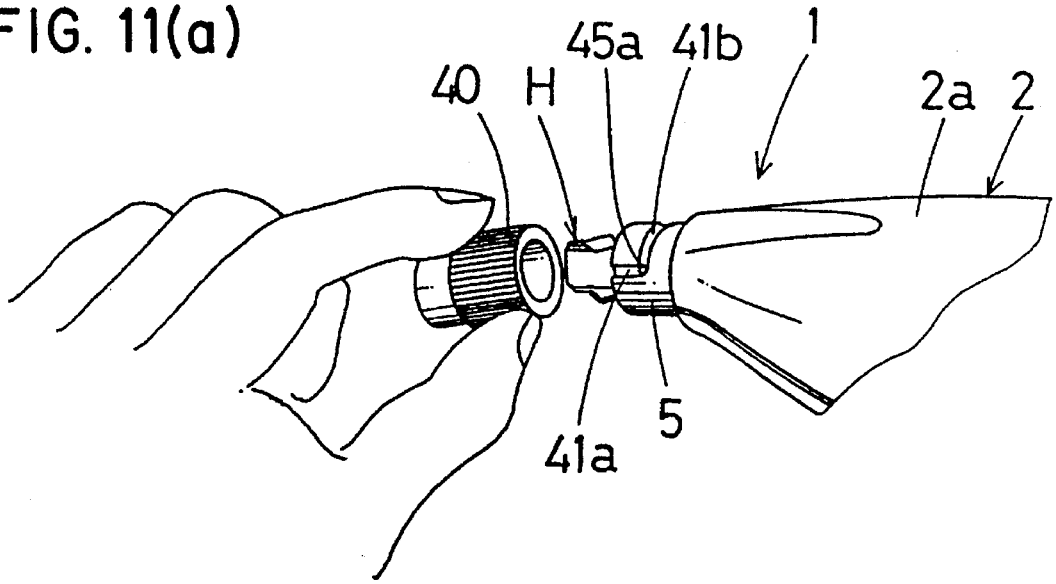
FIG. 11 is perspective views for explaining an operating method of the rotative part, FIG. 11 (a) showing how to attach a cap member to a cylindrical front end of the case, and FIG. 11 (b) how to rotate the cap member.
Figure 11B:
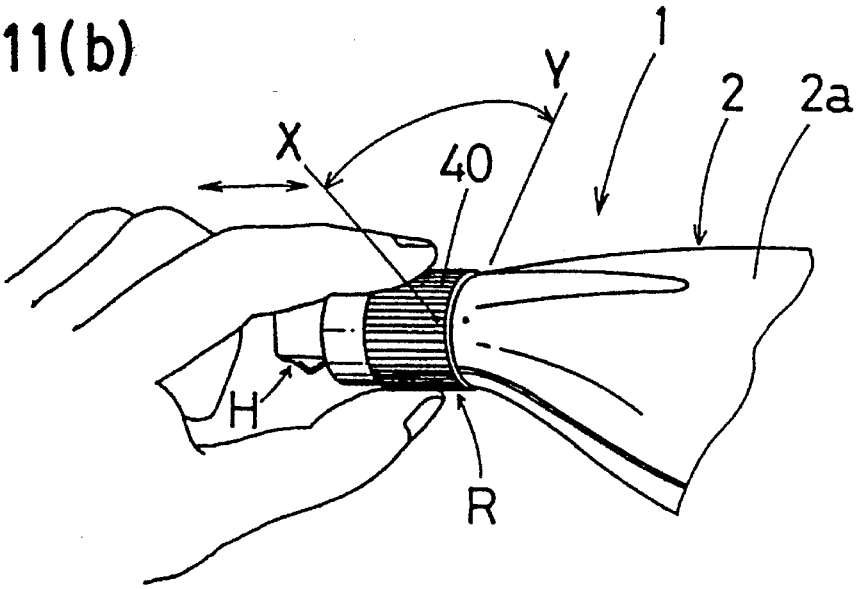

The tool can be used in two different ways by rotating the cap member 40 (see FIG. 11 (b)), and selectively positioning the head H in one of the vertical pulling use position X (in which the engagement projection 46 comes into engagement with the first engagement recess 45*a*) and lateral pulling use position Y (in which the engagement projection 46 comes into engagement with the second engagement recess 45*b*).

i) Vertical pulling use: (See FIG. 12 (a).)

This is suitable for partially correcting a sentence vertically written, for example, in Japanese, and can be achieved firstly by manually holding the case 2 in the gripping surfaces 2*a*, 2*b* like a writing tool. Then, by holding the tool in that attitude, the pressing part 35*a* in the front end of head H is brought into contact with the starting end (upper end) of a correction area (transfer area) 50 where an error or the like is present in a sheet, then, the case 2 is moved vertically or downward in relation to the sheet surface, and stopped when the pressing part 35*a* in the front end reaches the terminal end (lower end) of the correction area.

In such operation, the corrective paint layer (white) of coating film transfer tape T on the pressing part 35*a* of head H is separated from the base film, and transferred to cover the correction area 5, the error or the like is thereby erased, and a correct letter can be readily written on the white corrective paint layer.

ii) Lateral pulling use: (See FIG. 12 (b).)

This is suitable for partially correcting a sentence laterally written, for example, in English, and can be achieved firstly by manually holding the case 2 in the gripping surfaces 2*a*, 2*b* like a writing tool, and bringing the pressing part 35*a* in the front end of the head H into contact with the starting end (left end) of a correction area 50 with the tool still held in that attitude, as described above. Then, by moving the case 2 laterally or rightward in relation to the sheet surface until it reaches the terminal end (right end) of the correction area, an error or the like is erased, and again a correct letter can be readily written.

B. Replacement of tape cartridges

When the entire length of coating film transfer tape T is used, and wound by the winding reel 7 for collection from the pay-out reel 6, the tape cartridge C should be replaced with a new one according to the following steps.

i) Bring the head H into the coating film transfer tape replacement position X. In other words, although no operation is required when the head H is in the vertical pulling use position X, if it is in the lateral pulling use position Y, rotate the cap member 40 to rotatingly move the head H from the lateral pulling use position Y to the coating film transfer tape replacement position X.

By such operation, the coating film transfer tape T on the head H comes to be parallel to the winding attitude of the pay-out and winding reels 6, 7, as shown in FIG. 3, so that the coating film transfer tape T can be easily detached from the head H.

ii) Disassemble the case 2 open. In this operation, firstly, pull the cap member 40 off the cylindrical front end 5 of case 2, as shown in FIG. 11 (a), then, with the capping body 4 facing upward, lift the semicylindrical part 4*c* to remove the capping body 4 from the main body 3.

iii) Firstly, remove the used cartridge C (empty pay-out reel 6 and winding reel 7 with the used coating film transfer tape T' collected thereabout), then, place an unused new tape cartridge C (pay-out reel 6 with an unused coating film transfer tape T and winding reel 7) onto the tape drive D, and set the coating film transfer tape T through the pressing part 35*a* in the front end of head H.

In this operation, as shown in FIG. 1, by maintaining the coating film transfer tape T in such attitude as it is wound about the pay-out reel 6 and winding reel 7, drag vicinities 60*a*, 60*b* of the paid-out and wound portions through the guide pins 21, 22, and insert leading parts 60*c*, 60*d* of the tape in either sides of the main head 35 of head H from the upper side.

By such operation, as shown in FIG. 3, the coating film transfer tape T is inverted through the pressing part 3 in the front end of head H by means of the guide pin 21, after it is paid out of the pay-out reel 6, and set in such attitude as it is wound about the winding reel 7 by the guide pin 22.

Incidentally, the head H may be once removed from the pressing part 35*a* in the leading end of head H, and reattached after the sequential steps are performed.

iv) Then, the case 2 is closed, and reassembled. Here, the case 2 can be assembled by firstly bringing the engagement claw 4*b* of capping body 4 into engagement with the engagement part 3*b* of main body 3, then, mating the semicylindrical part 4*c* with the semicylindrical part 3*c* of main body 3 (the mating recess 3*a* comes into engagement with the mating rib 4*a*, accordingly), and inserting the cap member 40 to fit in the integrated cylindrical leading end 5, as shown in FIG. 11 (a).

Embodiment 2

Figure 13A:
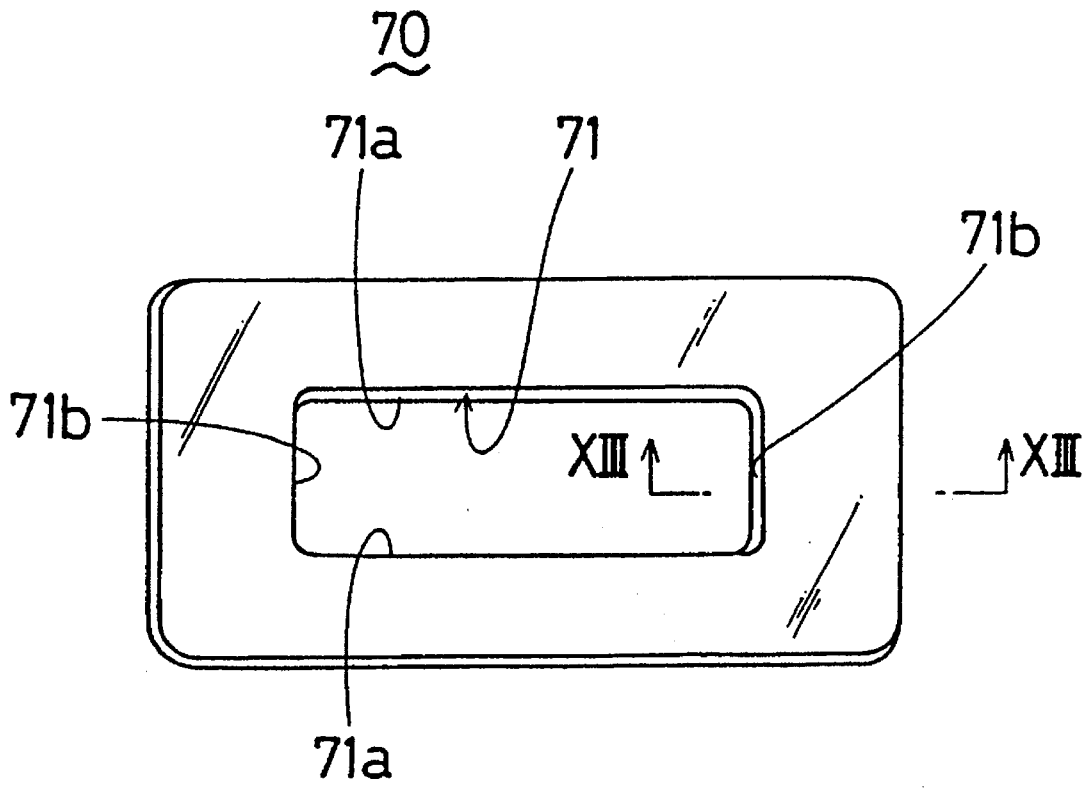
FIG. 13 shows a guide plate of an erasing tool forming a coating film transfer tool according to embodiment 2 of the invention, FIG. 13 (a) being a perspective view, and FIG. 13 (b) a sectional view taken along the line XIII—XIII of FIG. 13 (a).
Figure 13B:
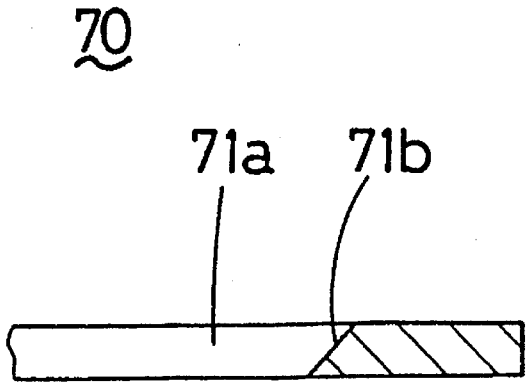

This embodiment comprises a guide plate 70 shown in FIG. 13, and preferably applicable to erase a narrow area.

Figure 12A:
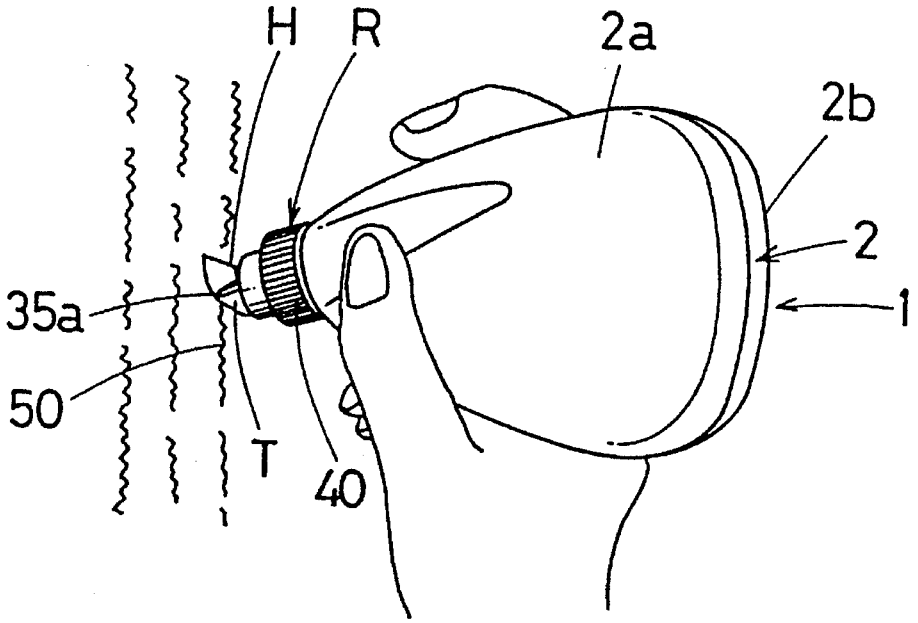
FIG. 12 is perspective views for explaining how to use the erasing tool, FIG. 12 (a) showing longitudinal pulling use, and FIG. 12 (b) lateral pulling use.
Figure 12B:
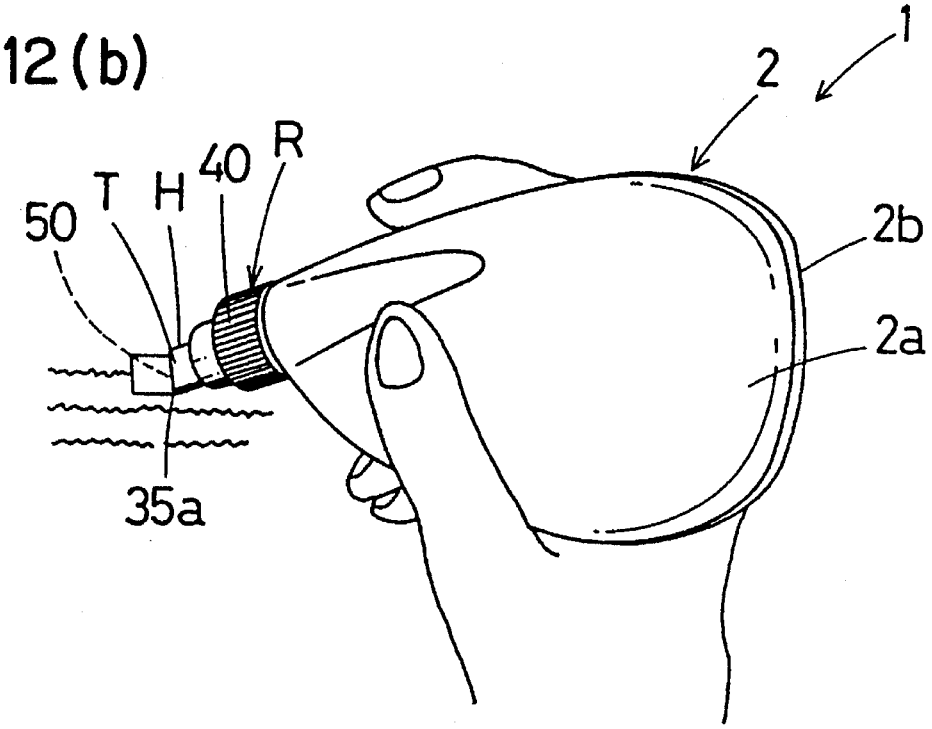

In other words, in the lateral pulling use, as illustrated in FIG. 12 (b), provision of only the erasing tool 1 of embodiment 1 is inconvenient for a user, because the head H assumes such attitude that it covers the correction area 50.

Therefore, although no problem is caused in erasing a relatively large letter, in the case of erasing such narrow area as small letters and only one letter in a sentence, it is sometimes difficult to securely erase a letter to be erased, because the terminal end (right end) of correction area 50 is hidden by the head H, and is difficult to be observed. In such case, the guide plate 70 is preferably used in conjunction with the erasing tool 1.

The guide plate 70 is for guiding the head H of erasing tool 1, and positioning it in the correction area 50, and comprises a transparent thin plastic plate formed in a rectangular shape with a rectangular window 71 corresponding to the outer circumferential configuration provided in a central part thereof.

In the window 71, two opposing sides, that is, longer sides 71*a*, 71*a* and shorter sides 71*b*, 71*b* are formed straight in parallel with each other, the longer sides 71*a*, 71*a* provide linear guides for guiding a side edge of the head H, and the shorter sides 71*b*, 71*b* terminal end defining parts for defining a terminal end of the correction area 50.

The terminal end defining part 71*b* has a surface inclined downward in the direction of the linear guide 71*a*, so that the white corrective paint layer of the coating film transfer tape T can be easily and securely cut off. The inclined structure may be eliminated depending on thickness of the guide plate 70.

Figure 14A:
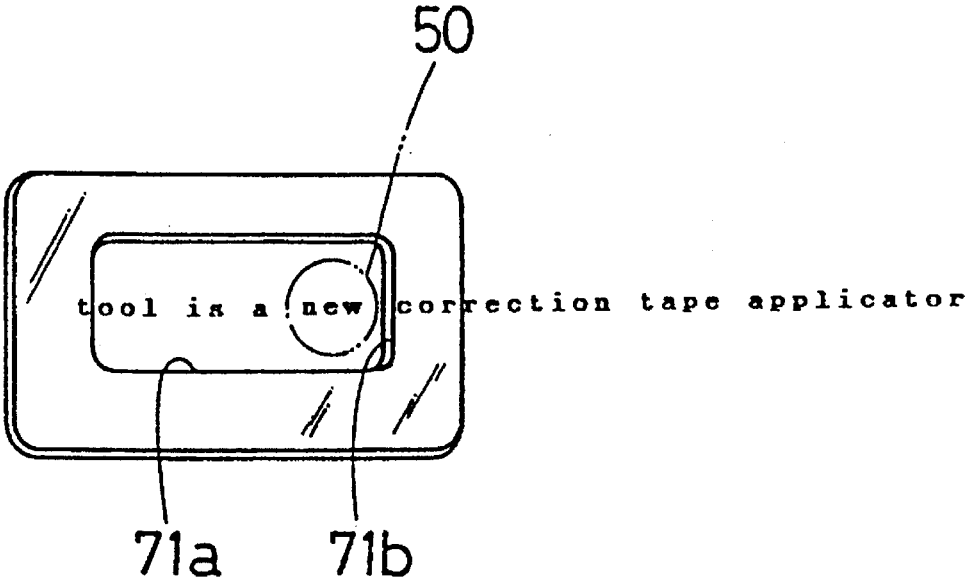
FIG. 14 is perspective views for explaining how to use the erasing tool in conjunction with the guide plat, FIG. 14 (a) showing the guide plate positioned on a correction area, and FIG. 14 (b) how to erase an error in the correction area by using the erasing tool along with the guide plate.
Figure 14B:
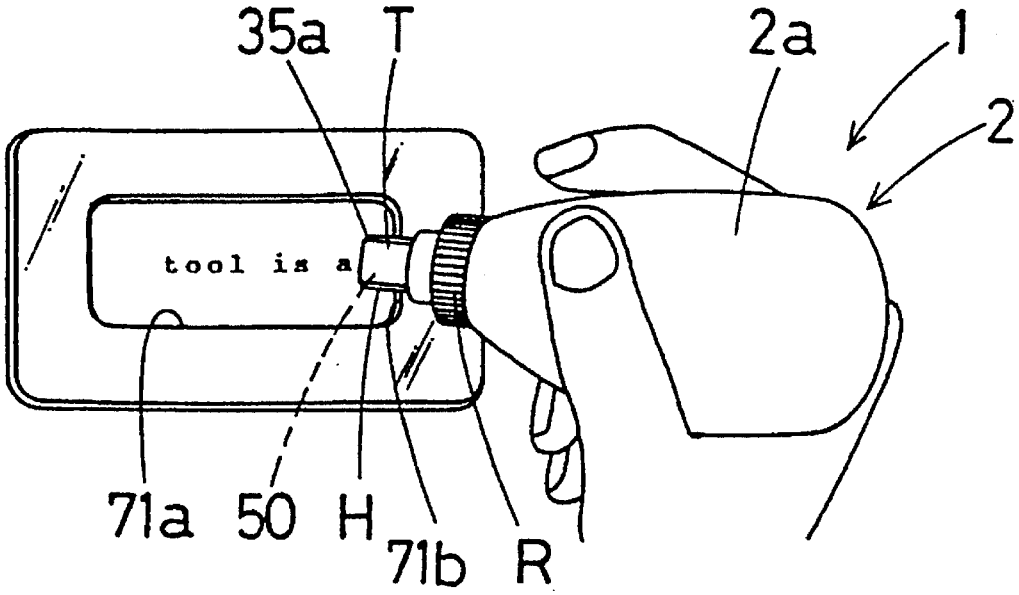

Thus, in a sentence laterally written, to erase such narrow correction area 50 as small letters and only one letter in the sentence, firstly, as shown in FIG. 14 (a), the terminal end defining part 71*b* of guide plate 70 is positioned in the terminal end of correction area 50, and the linear guide 71*a* along the lower vicinity of the correction part 50.

Succeedingly, as shown in FIG. 14 (b), after the pressing part 35*a* in the leading end of head H is placed to the starting end of correction area 50, the tool is moved over the correction area 50 laterally in the right direction until it comes into contact with the terminal end defining part 71*b*, following the linear guide 71*a* with the side edge of head H. In such manner, only those letters to be corrected can be erased without failure.

Figure 15:
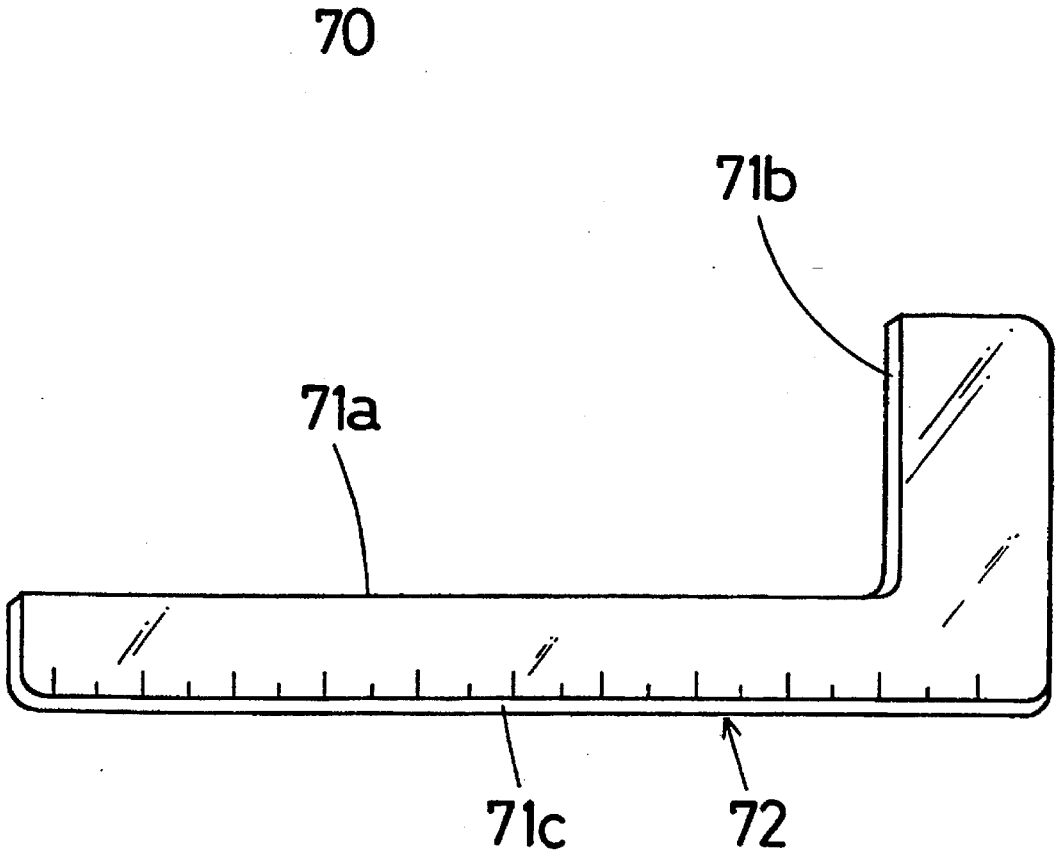
FIG. 15 is a perspective view showing a variation of the guide plate.

Incidentally, the guide plate 70 may be dimensionally configured in various designs according to a particular purpose as far as the linear guide 71*a* and terminal end defining part 71*b* are provided as main parts, and may be formed in L shape, for example, as shown in FIG. 15.

The guide plate 70 has gradations 72 in an outer straight linear part 71*c* parallel to the linear guide 71*a* for serving as a linear rule.

In the embodiments 1 and 2, by using an adhesive layer over a release agent layer formed on a side of a base film as the coating film transfer tape T, the tool is also applicable as an adhesive applicator for transferring only the adhesive layer to a sheet surface and the like.

Figure 16A:
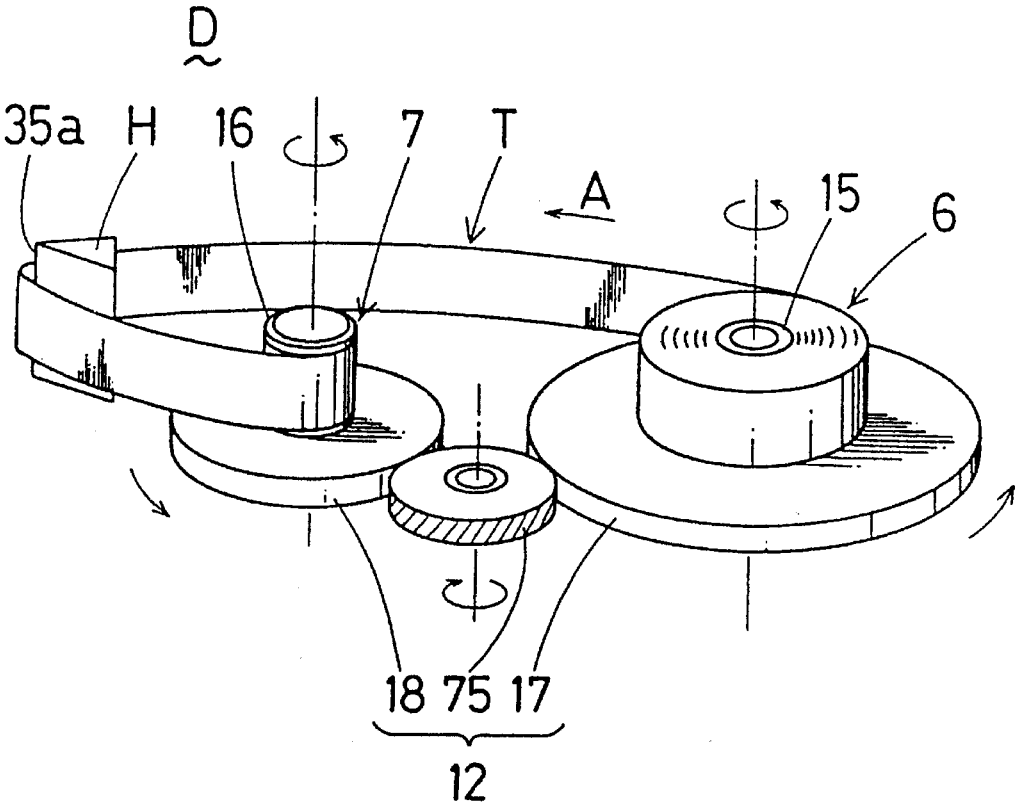
FIG. 16 is perspective views corresponding to FIG. 6 schematically showing a variation of tape drive in the erasing tool, FIG. 16 (a) showing a first variation, and FIG. 16 (b) a second variation.
Figure 16B:
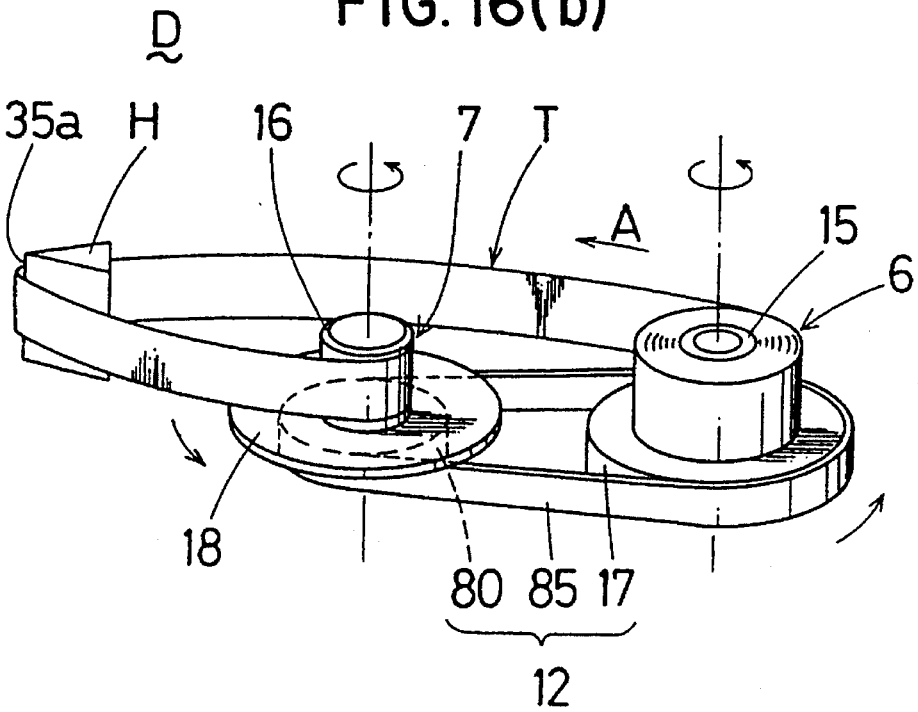
Figure 17:
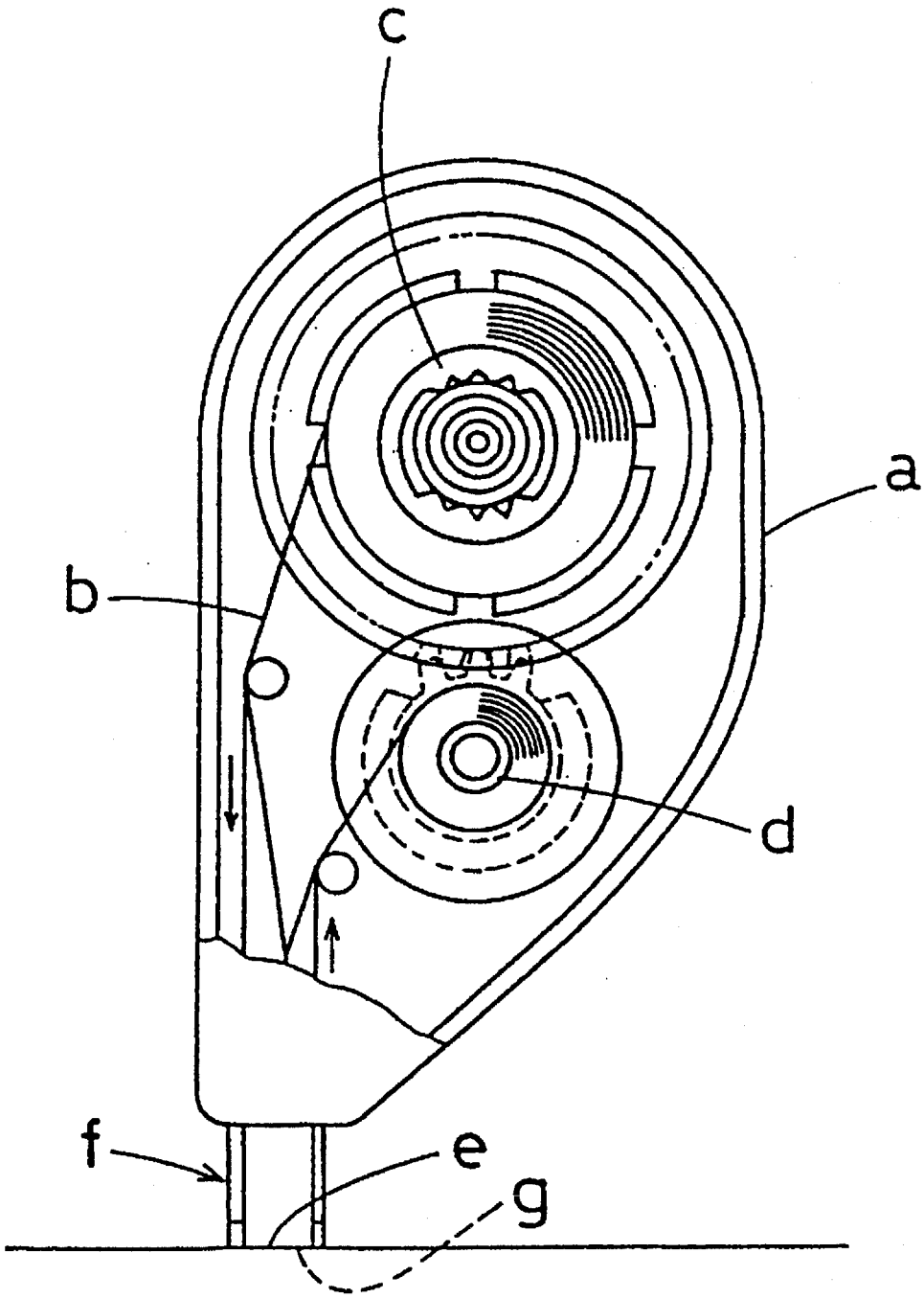
FIG. 17 PRIOR ART
FIG. 17 is a partly cut-open front view showing inner structure of a conventional erasing tool.

In addition, for the interlocking part 12, other structures as shown in FIG. 16 (a) or 16 (b) may be employed alternatively to that of FIG. 6.

In other word, an interlocking part 12 shown in FIG. 16 (a) comprises rotating disks 17, 18 constituting a part of the rotating winding part 11 and rotating pay-out part 10, respectively, and a frictional wheel 75.

In detail, the frictional wheel 75 comprises an outer circumferential part formed by such frictional material as silicone rubber, and is inserted between the rotating disks 17, 18 in the inner surface of main body 3. The outer circumference of frictional wheel 75 is frictionally engaged with the outer circumference of rotating disks 17, 18, respectively.

On the other hand, an interlocking part 12 shown in FIG. 16 (b) comprises the rotating disk 17, a rotation transferring part provided concentrically in a lower side of the rotating disk 18 and an endless belt 85.

The endless belt 85 is, in detail, formed of such soft plastic material as silicone rubber, and dragged about the outer circumference of the rotating disks 17 and rotation transferring part 80 to be in frictional contact therewith.

Furthermore, although the interlocking parts 12 shown in the figures are structurally arranged for functioning as a rotation transferring measure as well as a slide, these functions can be separately provided in independent manner, respectively, as disclosed in Japanese Laid-open Utility Patent No. 5-13800 and Japanese Laid-open Patent No. 5-58097.

Moreover, although the head H is structurally arranged to allow selection from two positions, the vertical pulling use position X and the lateral pulling use position Y, it may be constructed exclusively for lateral pulling use by eliminating the vertical pulling use position X.

As described in detail above, in a coating film transfer tool of the invention, because the coating film transfer head is rotative between the coating film transfer tape replacement position and the application position, and is constructed such that the coating film transfer tape is guided by the pressing part in the front end of head, facing approximately directly to the griping surfaces of the case in the application position, by holding the case itself like a writing tool, the coating film transfer tape can be tightly pressed against a sheet surface by means of the pressing part in the front end of head.

Accordingly, by manually holding the gripping surfaces of case, resting the hand onto a desk or the like without squaring an elbow, and moving it horizontally, that is, moving the case as if drawing a lateral line, a letter or the like can be erased, or an adhesive applied, thus, the tool is easily operated, and the head can be accurately and stably brought to a desired position.

In addition, because the pressing part in the front end of head is constructed such that the coating film transfer tape is guided in a same attitude as it is wound about the pay-out and winding reels in the coating film transfer tape replacement position, even when the tool is structurally arranged for use as a kind of a writing tool, it can be formed as a cartridge type for allowing replacement of the coating film transfer tape, and an optimal structure can be provided to meet the requirement of saving resources.

The invention may be embodied in other specific forms without departing from the spirit and essential characteristics thereof. The present embodiments are, therefore, to be considered in all respects as illustrative and not restrictive, the scope of the invention being indicated by the appended claims rather than by the foregoing description, and all changes that fall within the meaning and range of equivalency of the claims are, therefore, intended to be embraced therein.

What is claimed is:

1. A coating film transfer tool comprising:

operating means configured and dimensioned for allowing hand-held operation by one hand;

tape pay-out means detachably provided in the operating means for paying out a coating film transfer tape for supply;

tape pressing means projecting from a front end of the operating means for pressing the coating film transfer tape supplied by the tape pay-out means against a transfer area; and tape collecting means detachably provided in the operating means for collecting the coating film transfer tape guided through a pressing part in a front end of the tape pressing means after it is used, wherein the tape pressing means is rotative between a coating film transfer tape replacement position and an application position; and the pressing part in the front end of the tape pressing means guides the coating film transfer tape in a same attitude as it is wound about the tape pay-out means and tape collecting means in the coating film transfer tape replacement position, and such that the coating film transfer tape faces approximately directly to gripping surfaces of the operating means in the application position.

2. A coating film transfer tool comprising:

a case configured and dimensioned for allowing hand-held operation by one hand;

a pay-out reel rotatably and detachably provided in the case, and having a coating film transfer tape wound thereabout;

a coating film transfer head projecting from a front end of the case for pressing the coating film transfer tape against a transfer area; and a winding reel rotatably and detachably provided in the case for collecting the coating film transfer tape after use, wherein the head is rotative between a coating film transfer tape replacement position and an application position; and a pressing part in a front end of the head guides the coating film transfer tape in a same attitude as it is wound about the pay-out reel and winding reel in the coating film transfer tape replacement position, and such that the coating film transfer tape faces approximately directly to gripping surfaces of the case in the application position.

3. A coating film transfer tool according to claim 2, wherein the case is formed in a flat box shape having a geometric and widthwise dimensions for containing the pay-out reel and the winding reel, and flat front and back surfaces thereof provides the gripping surfaces.

4. A coating film transfer tool according to claim 3, wherein the case comprises a main body for attachment of the pay-out and winding reels, and a capping body detachably assembled with the main body.

5. A coating film transfer tool according to claim 2, wherein the head is attached to an inner circumference of a leading end of the case for rotation about an axis thereof; and a rotative part for rotatively operating the head is provided in the front end of the case.

6. A coating film transfer tool according to claim 5, wherein the rotative part comprises a cap member fitted over a cylindrical front end of the case for rotation about an axis thereof, and a positioning part provided on an outer circumference of the cylindrical front end resiliently positioning the cap member, and fixing it in position;

the cap member is provided with a through hole for receiving the head; and the through hole is configured and dimensioned such that the cap member and the head are integrally engaged with each other in a rotating direction, when the head is received in the hole.

7. A coating film transfer tool according to claim 6, wherein said case comprises a main body for attachment of the pay-out and winding reels, and a capping body detachably assembled with the main body wherein the cylindrical front end of the case is structurally divided, and comprising a semicylindrical part of the main body and a semicylindrical part of the capping body; and the cap member is detachably attached to an outer circumference of the cylindrical front end, and also serves as an assembly fixing member for the case.

8. A coating film transfer tool according to claim 6, wherein the positioning part comprises first and second engagement parts disengageably fitted to an engagement part that is formed in an inner circumference of the cap member;

the head is in the coating film transfer tape replacement position, when the engagement of cap member is in engagement with the first engagement part; and the head is in the application position, when the engagement part of cap member is in engagement with the second engagement part.

9. A coating film transfer tool according to claim 2, wherein a rotating pay-out part to which the pay-out reel is detachably mounted and a rotating winding part to which the winding reel is detachably mounted are rotatably provided in the case, respectively; and the rotating parts are interconnected by an interlocking part, and the rotating winding part is of an automatic winding structure that is driven in a dependent relationship with, the rotating pay-out part.

10. A coating film transfer tool according to claim 9, wherein the interlocking part functions also as slide means for synchronizing pay-out and winding speeds of the coating film transfer tape in the pay-out and winding reels.

11. A coating film transfer tool according to claim 10, wherein the interlocking part is provided with a frictional member employed on an outer circumference of one of the rotating pay-out part and the rotating winding part, and the frictional member is in frictional engagement with an outer circumference of the other rotating part.

12. A coating film transfer tool according to claim 10, wherein the interlocking part is provided with a frictional wheel rotatably placed in the case, and an outer circumference of the frictional wheel is in frictional engagement with the outer circumference of the rotating pay-out part and rotating winding part, respectively.

13. A coating film transfer tool according to claim 10, wherein the interlocking part is provided with an endless belt, and the endless belt is dragged through the outer circumference of the rotating pay-out part and rotating winding part, respectively, for frictional contact.

14. A coating film transfer tool according to claim 9 comprising:

a backstop mechanism for preventing inverse rotation of the pay-out and winding reels, wherein the backstop mechanism comprises a multiplicity of backstop claws employed in a circular form in an inner surface of a main body of the case, said main body for attachment of the pay-out and winding reels, and a stopping claw provided in the rotating pay-out part or rotating winding part, and disengageably engaged with the backstop claws.

15. A coating film transfer tool according to claim 2, wherein the coating film transfer tape comprises a base film made of a plastic material, paper or other suitable material, a release agent layer formed on one surface side of the base film, a white corrective paint layer formed over the release agent layer, and further a pressure sensitive adhesive layer applied over the paint layer.

16. A coating film transfer tool according to claim 2, wherein the coating film transfer tape comprises a base film made of a plastic material, paper or other suitable material and an adhesive layer formed on one surface side of the base film with a releasing agent layer inserted between them.

17. A coating film transfer tool according to claim 2 comprising:

a guide plate for guiding the head, and positioning it in relation to a transfer area, wherein the guide plate is formed of a transparent plastic plate, and comprises a linear guide for guiding a side edge of the head and a terminal end defining part continuously formed with the linear guide for defining a terminal end of the transfer area.

18. A coating film transfer tool according to claim 17, wherein the terminal end defining part of the guide plate has a slope inclined downward in the direction of the linear guide.

* * * * *